US007294803B2

(12) United States Patent
Lee et al.

(10) Patent No.: US 7,294,803 B2
(45) Date of Patent: Nov. 13, 2007

(54) KEY PAD AND KEYPAD ASSEMBLY

(75) Inventors: Joo-Hoon Lee, Yongin-si (KR); Sun-Tae Jung, Anyang-si (KR); Kyoung-Youm Kim, Seoul (KR); Byung-Duck Cho, Seoul (KR); Dong-Hoon Jang, Suwon-si (KR)

(73) Assignee: Samsung Electronics Co., Ltd., Maetan-Dong, Yeongtong-Gu Suwon-si, Gyeonggi-Do (KR)

( * ) Notice: Subject to any disclaimer, the term of this patent is extended or adjusted under 35 U.S.C. 154(b) by 0 days.

(21) Appl. No.: 11/300,942

(22) Filed: Dec. 15, 2005

(65) Prior Publication Data

US 2006/0260922 A1 Nov. 23, 2006

(30) Foreign Application Priority Data

May 19, 2005 (KR) ..... 10-2005-0042035
Jul. 15, 2005 (KR) ..... 10-2005-0064351

(51) Int. Cl.
*H01H 9/00* (2006.01)

(52) U.S. Cl. ..... 200/314; 200/341

(58) Field of Classification Search ..... 200/310–314, 200/341–345, 512–520
See application file for complete search history.

(56) References Cited

U.S. PATENT DOCUMENTS

| | | | | |
|---|---|---|---|---|
| 4,343,975 A | | 8/1982 | Sado | 200/314 |
| 5,128,842 A | | 7/1992 | Kenmochi | 362/95 |
| 5,397,867 A | * | 3/1995 | Demeo | 200/5 A |
| 5,491,313 A | | 2/1996 | Bartley et al. | 200/310 |
| 5,568,367 A | | 10/1996 | Park | 362/109 |
| 5,573,107 A | | 11/1996 | Nakano et al. | 200/314 |
| 5,661,279 A | * | 8/1997 | Kenmochi | 200/314 |
| 5,664,667 A | * | 9/1997 | Kenmochi | 200/314 |
| 5,766,981 A | | 6/1998 | Thornton et al. | 438/36 |
| 5,847,336 A | * | 12/1998 | Thornton | 200/5 A |
| 6,462,294 B2 | * | 10/2002 | Davidson et al. | 200/512 |
| 6,467,924 B2 | * | 10/2002 | Shipman | 362/600 |
| 6,834,973 B2 | * | 12/2004 | Ohkawa | 362/617 |
| 2003/0103359 A1 | | 6/2003 | Chiang et al. | |
| 2004/0018796 A1 | | 1/2004 | Hamada | |
| 2005/0150753 A1 | * | 7/2005 | Hsu | 200/314 |
| 2005/0167254 A1 | * | 8/2005 | Oosawa | 200/314 |

FOREIGN PATENT DOCUMENTS

| | | |
|---|---|---|
| EP | 0552497 B1 | 10/1997 |
| JP | 61-202549 | 9/1986 |
| JP | 03-257728 | 11/1991 |
| JP | 04-022023 | 1/1992 |
| JP | 2002-300258 | 10/2002 |

* cited by examiner

*Primary Examiner*—Elvin Enad
*Assistant Examiner*—Lisa Klaus
(74) *Attorney, Agent, or Firm*—Cha & Reiter, LLC

(57) ABSTRACT

A keypad includes a light guide panel, the interior of which light propagates through; at least one key button positioned on the upper surface of the light guide panel; and at least one reflective pattern fixedly positioned with respect to the light guide panel to reflect a part of the light, which propagates through the interior of the light guide panel, towards the key button.

21 Claims, 6 Drawing Sheets

KEY PAD AND KEYPAD ASSEMBLY

CLAIM OF PRIORITY

This application claims priority to an application entitled "Key Pad and Key Pad Assembly," filed with the Korean Intellectual Property Office on May 19, 2005 and assigned Serial No. 2005-42035, and an application entitled "Key Pad and Key Pad Assembly," filed with the Korean Intellectual Property Office on Jul. 15, 2005 and assigned Serial No. 2005-64351, the contents of both being incorporated herein by reference.

BACKGROUND OF THE INVENTION

1. Field of the Invention

The present invention relates to a keypad used in a portable terminal, and more particularly to a keypad and a keypad assembly having a light guide panel.

2. Description of the Related Art

A keypad used in a portable terminal typically includes an elastic pad having the shape of a plate, a plurality of key buttons formed on the upper surface of the elastic pad with characters printed on the upper surface thereof, respectively, and a plurality of protrusions (or actuators) formed on the lower surface of the elastic pad and at the opposite end of the upper surface of the elastic pad. The portable terminal is commonly provided with a number of light emitting devices, i.e., 15-20, serving as a backlight source for the keypad.

FIG. 1 is a sectional view of a keypad assembly according to the prior art. The keypad assembly 100 includes a keypad 110, a switch board 150, and a plurality of light emitting diodes (LEDs) 170.

The keypad 110 includes an elastic pad 120, a plurality of key buttons 140 formed on the upper surface 122 of the elastic pad 120 with characters, etc. printed thereof, and a plurality of protrusions 130 formed on the lower surface 124 of the elastic pad 120, which is opposite to the upper surface 122 of the elastic pad 120. Each of the protrusions 130 is aligned with the center of the corresponding key buttons 140. The elastic pad 120 may have a plurality of grooves 126 formed on the lower surface 124 thereof, and the grooves 126 are positioned around the respective protrusions 130 to prevent the LEDs 170 from interfering with the protrusions 130.

The switch board 150 has a plate-shaped PCB (Printed Circuit Board) 155 and a plurality of switches 160 formed on the upper surface of the PCB 155 facing the keypad 110. Each switch 160 is comprised of a conductive contact member 162 and a conductive dome 164 covering the contact member 162 completely.

The plurality of LEDs 170 is mounted on the upper surface of the PCB 155, and each LED 170 is covered by the corresponding grooves 126 of the elastic pad 120.

In operation, if a user presses one of the key buttons 140, the portion of the keypad 110 positioned beneath the pressed key button 140 deforms towards the switch board 150. As a result, one of the protrusions 130 corresponding to the deformed portion activates the corresponding dome 164, which in turn makes an electrical contact with the corresponding contact member 162.

In designing the switches 160, the LEDs 170 must not be positioned beneath the corresponding key buttons 140. Light outputted from the respective LEDs 170 passes through the elastic pad 120 and illuminates the respective key buttons 140 at an oblique angle. As a result, the key buttons 140 are dimly illuminated in a non-uniform fashion. Thus, the center of each key button 140 looks darker and the periphery thereof looks brighter. To address this, if more LEDs are installed to enhance the illumination of the key buttons 140 more uniformly, a higher power consumption and manufacturing cost can result.

SUMMARY OF THE INVENTION

Accordingly, the present invention has been made to solve the above-mentioned problems occurring in the prior art and provides additional advantages, by providing a keypad and a keypad assembly capable of realizing uniform and high brightness, as well as low power consumption and manufacturing cost.

In one embodiment, there is provided a keypad including a light guide panel, the interior of which light propagates through; at least one key button positioned on the upper surface of the light guide panel; and at least one reflective pattern fixedly positioned with respect to the light guide panel to reflect a part of the light, which propagates through the interior of the light guide panel, towards the key button.

In accordance with another aspect of the present invention, there is provided a keypad assembly including a keypad having a light guide panel, the interior of which light propagates through, at least one key button positioned on the upper surface of the light guide panel, and at least one reflective pattern locally formed on the light guide panel to reflect a part of the light, which propagates through the interior of the light guide panel, towards the key button and a switch board having at least one switch formed on its upper surface, which faces the keypad, wherein, as the key button is pressed, the portion of the keypad deformed towards the switch board presses the switch.

In accordance with another aspect of the present invention, there is provided a portable terminal including a switch board having at least one switch positioned on the upper surface thereof; a keypad having a light guide panel with upper, lower, and lateral surfaces and at least one key button positioned on the upper surface of the light guide panel above the switch; and at least one light emitting device positioned adjacent to at least one of the lateral surfaces of the light guide panel, wherein the keypad has at least one reflective pattern formed on a portion of the upper or lower surface of the light guide panel, which is positioned under the key button, to reflect a part of light, which propagates through the interior of the light guide panel, towards the key button and the light guide panel is made of a transparent elastomer material.

BRIEF DESCRIPTION OF THE DRAWINGS

The above features and advantages of the present invention will be more apparent from the following detailed description taken in conjunction with the accompanying drawings, in which.

DETAILED DESCRIPTION

Hereinafter, embodiments of the present invention will be described with reference to the accompanying drawings. For the purposes of clarity and simplicity, a detailed description of known functions and configurations incorporated herein is omitted to avoid making the subject matter of the present invention unclear.

Figure 1:
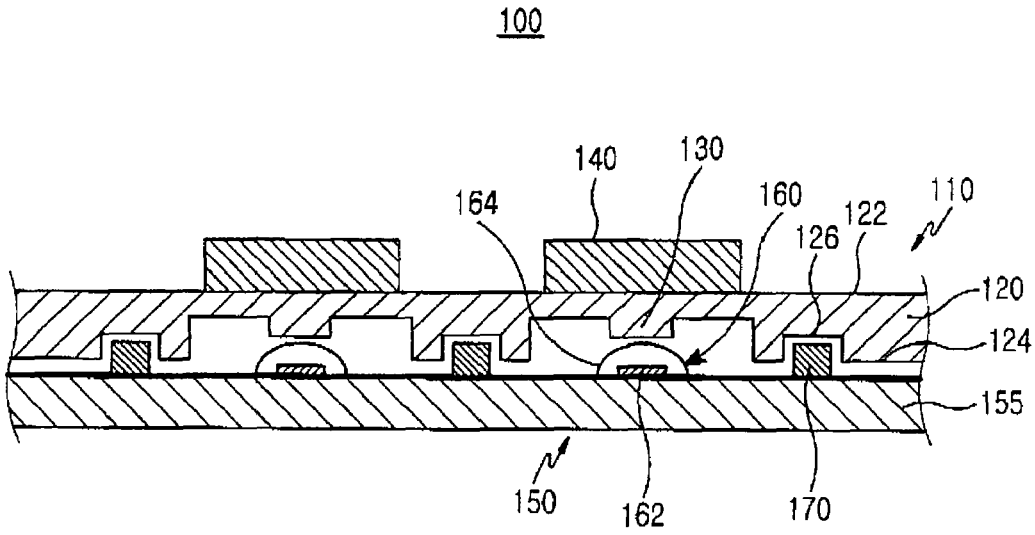
FIG.1 (PRIOR ART)
FIG. 1 is a sectional view showing a keypad assembly according to the prior art.
Figure 2:
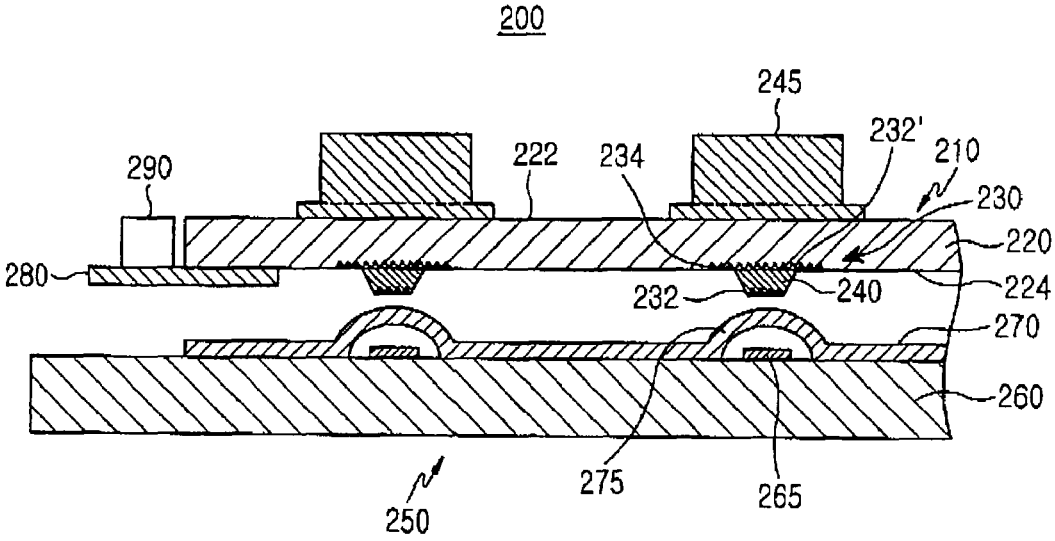
FIG. 2 is a sectional view showing a keypad assembly according to a first embodiment of the present invention.

FIG. 2 is a sectional view showing a keypad assembly according to a first embodiment of the present invention. As shown, the keypad assembly 200 includes a keypad 210, a switch board 250 facing the keypad 210, at least one light emitting device 290, and a second PCB 280.

The keypad 210 includes a light guide panel 220, a plurality of key buttons 245, a plurality of protrusions 240, and a plurality of reflective patterns 230 (indicated by solid triangles).

The light guide panel 220 retains light traveling inside thereof. The coupled light propagates from one lateral surface of the light guide panel 220 to the opposite lateral surface end thereof. The light guide panel 220 may have any shape, such as a square. The light coupled to the interior of the light guide panel 220 propagates inside the light guide panel 220 due to a total reflection, which occurs at the interface between the light guide panel 220 and the external air layer. The light guide panel 220 has elasticity so that the key buttons 245, when pressed, can return to the original position. That is, the light guide panel 220 has self-restoration properties so that it can restore the original shape after deformation and, after the key buttons 245 are operated, returns them to the original position.

Conventional light guide panels are manufactured by injection-molding of polycarbonate or acryl-based resin which has high transmittance for visible rays. However, they have low elastic modulus, poor elastic restoration properties, and high hardness. This makes it difficult to obtain a good click feel when pressing key buttons. Also, when a key button is pressed, adjacent key buttons may be erroneously operated together (interference among key buttons). Further, a permanent deformation may easily occur in the light guide panels after repeated operation over a long period of time.

Therefore, the light guide panel 220 according to the present invention is made of a highly transparent elastomer material, preferably polyurethane or silicone, which has low hardness, high elastic modulus, excellent elastic restoration properties, and high optical transmittance, in order to provide a good click feel, suppress interference among key buttons 245, and avoid the permanent deformation even after repeated operation.

The plurality of key buttons 245 are formed on the upper surface 222 of the light guide panel 220 and have characters, numeral, etc., printed on the upper surface thereof, respectively. The key buttons 245 may be formed in one piece with the light guide panel 220 using a material identical to or different from that of the light guide panel 220. Alternatively, the key buttons 245 may be separately formed using polycarbonate or acryl-based resin and attached to the upper surface 222 of the light guide panel 220. Each key button 245 may have any shape, such as a circular post or elliptical post.

The plurality of protrusions 240 is formed on the lower surface 224 of the light guide panel 220, which is opposite to the upper surface 222 of the light guide panel 220. The protrusions 240 may be formed in one piece with the light guide panel 220 using a material identical to or different from that of the light guide panel 220. Alternatively, the protrusions 240 may be separately formed and attached to the lower surface 224 of the light guide panel 220. Each protrusion 240 may have any shape, such as a truncated cone or trapezoidal hexahedron. Each protrusion 240 is aligned under the corresponding key button 245 (in a direction along the thickness of the keypad assembly 200 or perpendicular to the upper surface of the first PCB 260).

Figure 3A:
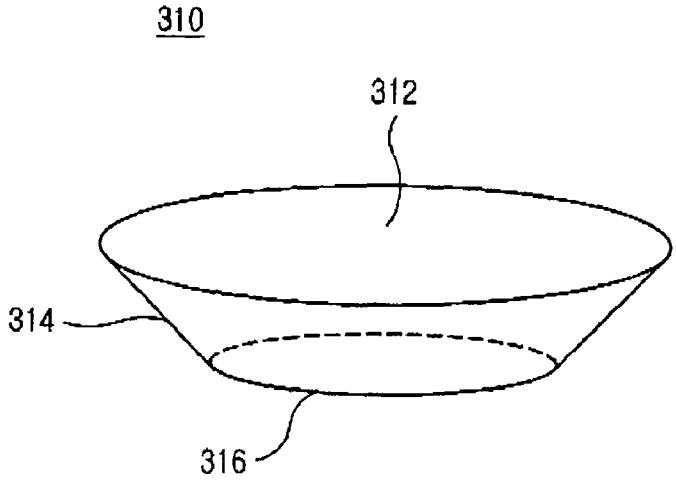
FIG. 3*a* shows an example of a protrusion according to the present invention.
Figure 3B:
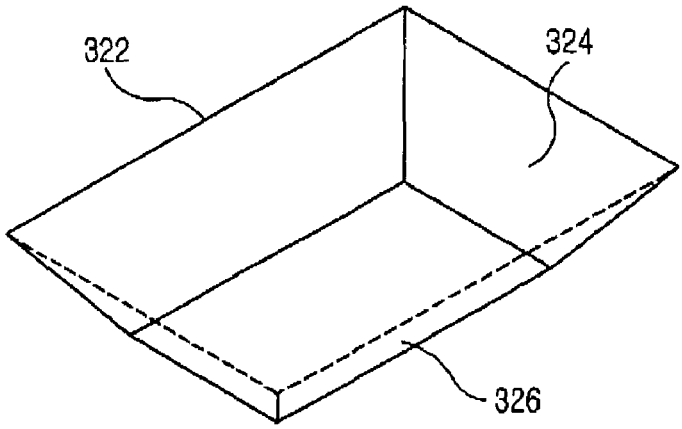
FIG. 3*b* shows another example of a protrusion according to the present invention.

FIGS. 3*a* and 3*b* show examples of a protrusion according to the present invention. Specifically, FIG. 3*a* shows a protrusion 310 having the shape of a truncated cone including elliptical upper and lower surfaces 312 and 316 and a slanted lateral surface 314. FIG. 3*b* shows a protrusion 320 having the shape of a trapezoidal hexahedron including rectangular upper and lower surfaces 322 and 326 and four trapezoidal lateral surfaces 324.

The keypad 210 has a plurality of reflective patterns 230 formed on the lower surface of the light guide panel 220 to reflect a part of light, which propagates into the light guide panel 220, towards the corresponding key buttons 245, respectively. If necessary, the reflective patterns may be formed on the upper surface of the light guide panel 220. Each reflective pattern 230 is formed at and around the corresponding protrusion 240 positioned just under the corresponding key button 245 to uniformly illuminate it. In the entire keypad 210, the density or size of reflective patterns positioned closer to the light emitting device 290 is different from that of reflective patterns positioned farther from the light emitting device 290, in order to uniformly adjust the overall distribution of light quantity emerging from the upper side of the light guide panel 220 regardless of the distance from the light emitting device 290. For example, when the quantity of light emerging from positions closer to the light emitting device 290 becomes greater, the density of reflective patterns closer to the light emitting device 290 is set lower. When the quantity of light emerging from positions farther from the light emitting device 290 is lessened, the density of reflective patterns farther from the light emitting device is set higher. In this manner, the distribution of quantity of emergent light, particularly the overall illumination distribution of the key buttons 245 can be uniform and bright.

Figure 4:
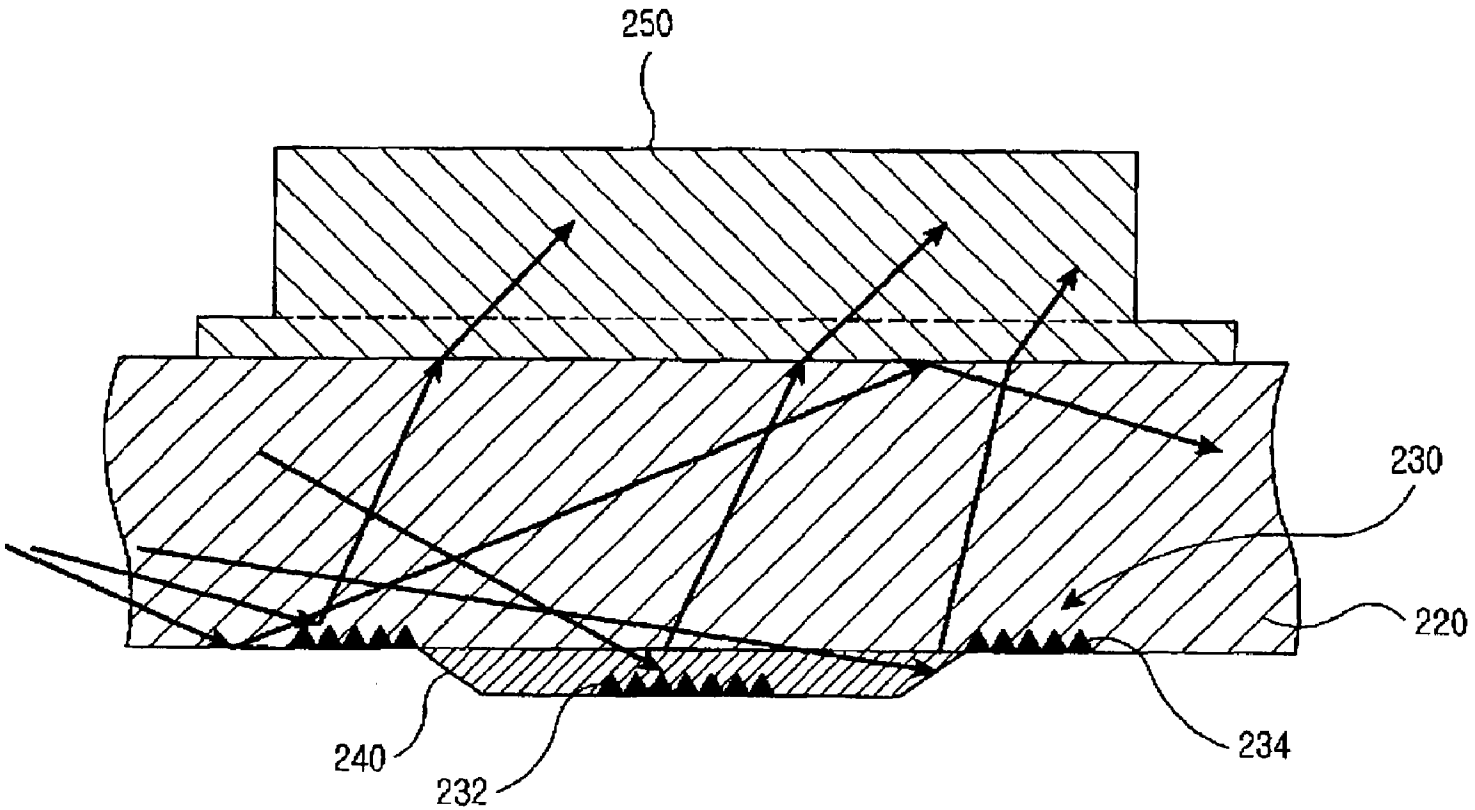
FIG. 4 shows the reflective patterns shown in FIG. 2.

FIG. 4 shows reflective patterns according to the present invention. The central portion 232 of the reflective patterns 230 is formed on the lower surface of a protrusion 240 and the peripheral portion 234 thereof is formed around the protrusion 240. As shown, light propagating into the light guide panel 220 due to total reflection is incident on the reflective patterns 230. Most light diffuse reflected by the reflective patterns 230 towards a key button 245 cannot satisfy the condition of total reflection (when incident angle is smaller than critical angle) and passes through the key button 245 to the exterior. In addition, light passing through the reflective patterns 230 without diffuse reflection and a part of the diffuse reflected light satisfy the condition of total reflection and continuously propagate inside the light guide panel 220 while contributing to illumination of other key buttons. In this manner, the reflective patterns 230 cause diffuse reflection and use only a part of incident light for illumination of the key button 245 and the rest for illumination of other key buttons. Furthermore, the reflective patterns 230 realize uniform illumination of the key button 245 by means of diffuse reflection in an arbitrary direction. Preferably, the reflective patterns 230 are formed by scratching or printing.

As shown in FIG. 2, the central portion 232' (indicated by hollow triangles) of the reflective patterns 230 may be formed between the light guide panel 220 and the protrusion 240, not on the lower surface of the protrusion 240.

The switch board 250 includes a first PCB 260 and a dome sheet 270.

The first PCB 260 has a plurality of conductive contact members 265 formed on the upper surface thereof, which constitute switches 265 and 275 together with corresponding domes 275. The switches 265 and 275 are aligned under the corresponding protrusions 240.

The dome sheet 270 is coupled to the upper surface of the first PCB 260 and includes a plurality of semi-spherical conductive domes 275, which completely cover the corresponding contact members 265.

When the user presses one of the key buttons 245, the portion of the keypad 210 positioned beneath the pressed key button 245 deforms towards the switch board 250. As a result, one of the protrusions 240 corresponding to the deformed portion presses the corresponding dome 275, which in turn makes an electrical contact with the corresponding contact member 265.

The second PCB 280 is attached to the periphery of the lower surface 224 of the light guide panel 220. The light emitting device 290 is mounted on the upper surface of the second PCB 280 with its light emitting surface facing the lateral surface of the light guide panel 220. Light emerging from the light emitting device 290 is coupled to the interior of the light guide panel 220 via the lateral surface thereof. The second PCB 280 may be made of a conventional flexible PCB (FPCB) and the light emitting device may be a conventional LED.

Figure 5A:
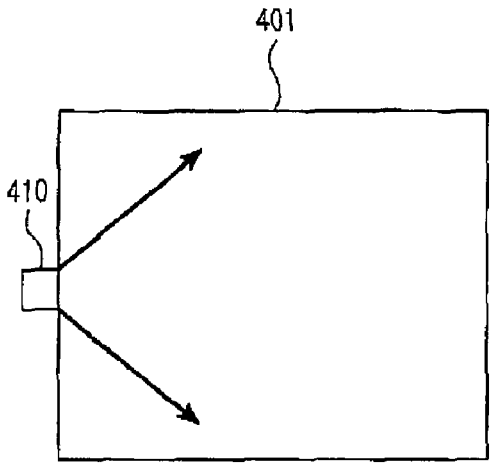
FIG. 5*a* shows an example of the construction of a light emitting device according to the present invention.
Figure 5B:
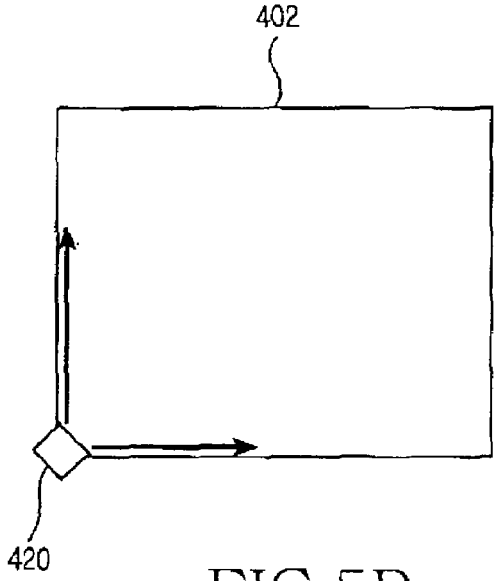
FIG. 5*b* shows another example of the construction of a light emitting device according to the present invention.
Figure 5C:
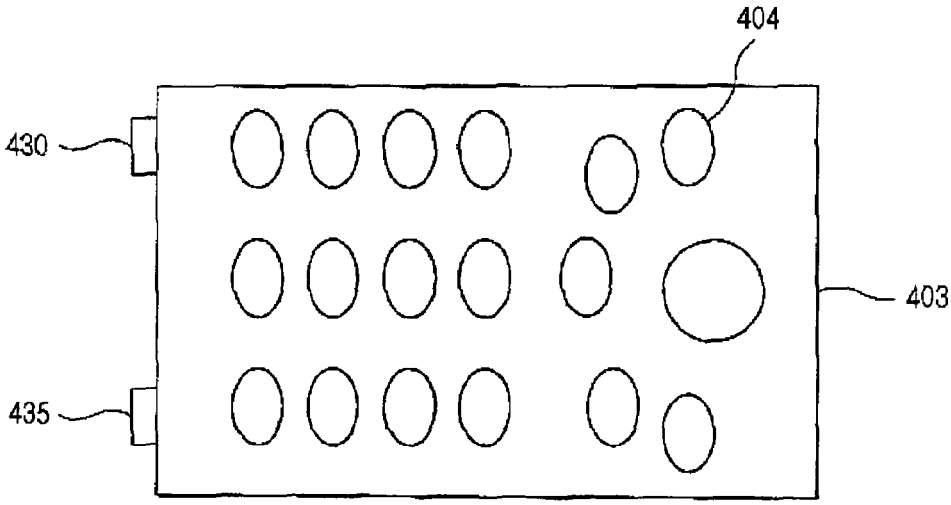
FIG. 5*c* shows another example of the construction of a light emitting device according to the present invention.

FIGS. 5*a*, 5*b*, and 5*c* show examples of the construction of a light emitting device according to the present invention. Particularly, FIG. 5*a* is a front view showing a light emitting device 410 positioned at the center of a lateral surface of a light guide panel 401. FIG. 5*b* is a front view showing a light emitting device 420 positioned at a corner of a light guide panel 402. FIG. 5*c* is a front view showing first and second light emitting devices 430 and 435 positioned on a lateral surface of a light guide panel 403 with a spacing and a number of key buttons attached to the light guide panel 403.

As shown, the number and position of the light emitting device according to the present invention can be determined selectively.

Figure 6:
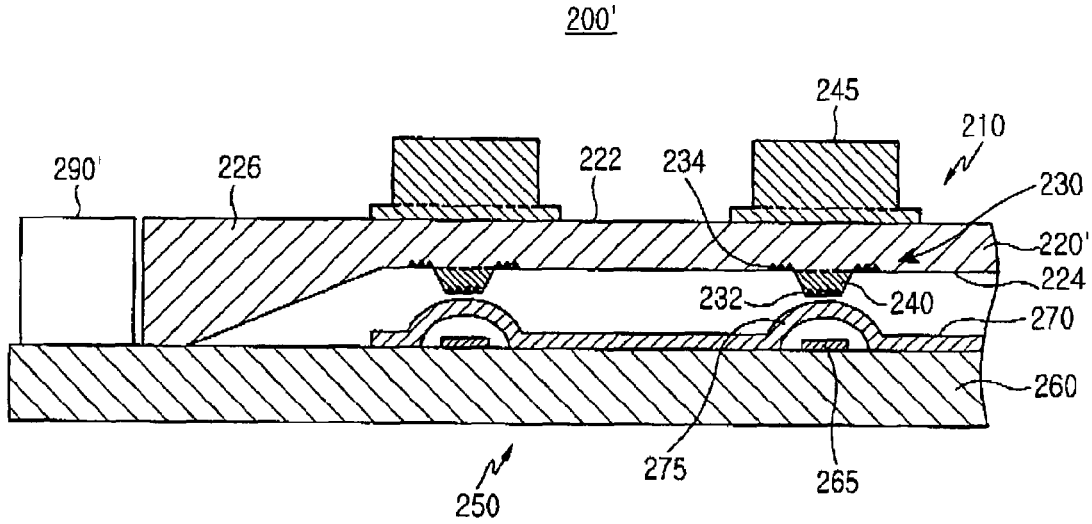
FIG. 6 is a sectional view showing a keypad assembly according to a second embodiment of the present invention.

FIG. 6 is a sectional view showing a keypad assembly according to a second embodiment of the present invention. The keypad assembly 200' has a construction similar to that of the keypad assembly 200 shown in FIG. 2, except for the shape of the light guide panel 220' and the position of the light emitting device 290'. Therefore, the same components are given the same reference numerals and repeated description thereof will be omitted to avoid redundancy.

The light guide panel 220' generally has the shape of a square plate and guides light coupled to the interior thereof. A peripheral portion 226 of the light guide panel 220' extends with a slant to the upper surface of the PCB 260.

At least one light emitting device 290' is mounted on the upper surface of the PCB 260 with its light emitting surface facing the lateral surface of the slant portion 226 of the light guide panel 220'. Light emerging from the light emitting device 290' is coupled to the interior of the light guide panel 220' via the lateral surface thereof.

When compared with the above-mentioned first embodiment, the second embodiment is advantageous in that the shape of the light guide panel 220' is modified so that no flexible PCB is necessary for wiring of the light emitting device 290' and the keypad assembly 200' can be realized in a more economical manner.

Figure 7:
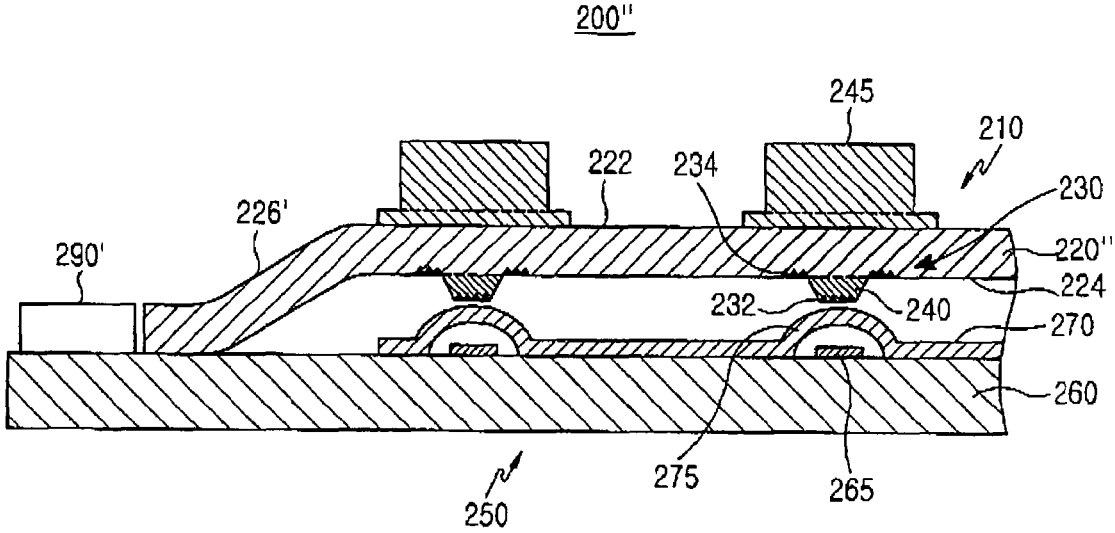
FIG. 7 is a sectional view showing a keypad assembly according to a third embodiment of the present invention.

FIG. 7 is a sectional view showing a keypad assembly according to a third embodiment of the present invention. The keypad assembly 200" has a construction similar to that of the keypad assembly 200' shown in FIG. 6, except for the shape of the light guide panel 220". Therefore, the same components are given the same reference numerals and repeated description thereof will be omitted to avoid redundancy.

The light guide panel 220" has the shape of a square plate with a constant thickness and light coupled to the interior thereof. A peripheral portion 226' of the light guide panel 220" bends in such a manner that it extends to the upper surface of the PCB 260. Particularly, the peripheral portion 226' of the light guide panel 220", which may be made of an elastomer material, such as silicone, may be bent at an angle as shown in the drawing for optical connection between the light guide panel 220" and the light emitting device 290', which are in different vertical positions.

The light emitting device 290' is mounted on the upper surface of the PCB 260 with its light emitting surface facing the lateral surface of the peripheral portion 226' of the light guide panel 220". Light emerging from the light emitting device 290' is coupled to the interior of the light guide panel 220" via the lateral surface thereof.

As mentioned above, the keypad and the keypad assembly according to the present invention are advantageous in that the elastic light guide panel positioned between the key buttons, and the shape and design of protrusions makes it possible to illuminate the key buttons uniformly and brightly and reduce the number of necessary light emitting devices, power consumption, and manufacturing cost.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A keypad comprising:

a light guide panel for propagating light there through from one lateral surface of the light guide panel to another lateral surface of the light guide panel opposite to the one lateral surface;

at least one key button disposed on the upper surface of the light guide panel;

at least one reflective pattern fixedly positioned with respect to the light guide panel to reflect a part of the light propagating inside the light guide panel towards the key button; and at least one light emitting device positioned to face the one lateral surface of the light guide panel and adapted to couple light to the interior of the light guide panel, wherein the density of reflective patterns closer to the light emitting device is set lower and the density of reflective patterns farther from the light emitting device is set higher to uniformly adjust the overall distribution of quantity of light emerging from the upper side of the light guide panel.

2. The keypad as claimed in claim 1, wherein at least one reflective pattern is locally formed on the light guide panel.

3. The keypad as claimed in claim 1, further comprising at least one protrusion formed on the lower surface of the light guide panel.

4. The keypad as claimed in claim 3, wherein the reflective pattern is formed on the lower surface of the light guide panel, which is opposite to the upper surface of the light guide panel, around the protrusion.

5. The keypad as claimed in claim 3, wherein the reflective pattern is formed on the protrusion.

6. The keypad as claimed in claim 3, wherein the reflective pattern is formed on the lower surface of the light guide panel, which is opposite to the upper surface of the light guide panel, between the light guide panel and the protrusion.

7. The keypad as claimed in claim 1, wherein the reflective pattern is adapted to cause a diffuse reflection.

8. The keypad as claimed in claim 1, wherein the light guide panel is made of a transparent elastomer material and is adapted to enable the key button to an original position after operation of the key button.

9. The keypad as claimed in claim 8, wherein the light guide panel is made of polyurethane or silicone.

10. A keypad assembly comprising:

a keypad having a light guide panel, the interior of which light propagates through from one lateral surface of the light guide panel to another lateral surface of the light guide panel opposite to the one lateral surface, at least one key button disposed on the upper surface of the light guide panel, and at least one reflective pattern locally formed on the light guide panel to reflect a part of the propagated light towards the key button;

at least one light emitting device positioned to face the on elateral surface of the light guide panel and adapted to couple light to the interior of the light guide panel;

a switch board having at least one switch formed on its upper surface, which faces the keypad, wherein as the key button is pressed, a portion of the keypad deformed towards the switch board activates the switch; and a printed circuit board (PCB) is coupled to a periphery of the lower surface of the light guide panel and the light emitting device is mounted on the upper surface of the PCB.

11. The keypad assembly as claimed in claim 10, wherein a peripheral portion of the light guide panel extends at a slant angle to the upper surface of the switch board and the light emitting device is mounted on the upper surface of the switch board.

12. The keypad assembly as claimed in claim 10, wherein the keypad has at least one protrusion formed on the lower surface of the light guide panel for activating the switch.

13. The keypad assembly as claimed in claim 12, wherein the reflective pattern is formed on the lower surface of the light guide panel, which is opposite to the upper surface of the light guide panel, around the protrusion.

14. The keypad assembly as claimed in 12, wherein the reflective pattern is formed on the protrusion.

15. The keypad assembly as claimed in claim 10, wherein the reflective pattern is adapted to cause a diffuse reflection.

16. The keypad assembly as claimed in claim 10, wherein the light guide panel is made of a transparent elastomer material and is adapted to enable the key button to an original position after operation of the key button.

17. The keypad assembly as claimed in claim 16, wherein the light guide panel is made of polyurethane or silicone.

18. The keypad assembly as claimed in claim 10, wherein the density of reflective patterns closer to the light emitting device is set lower and the density of reflective patterns farther from the light emitting device is set higher to uniformly adjust the overall distribution of quantity of light emerging from the upper side of the light guide panel.

19. A portable terminal comprising:

a switch board having at least one switch positioned on the upper surface thereof;

a keypad having a light guide panel with upper, lower, and lateral surfaces and at least one key button disposed on the upper surface of the light guide panel above the switch; and at least one light emitting device positioned to face one of the lateral surfaces of the light guide panel and adapted to couple light to the interior of the light panel, wherein the keypad has at least one reflective pattern fanned on a portion of the upper or lower surface of the light guide panel, which is positioned under the key button, to reflect a part of light, towards the key button, and the light guide panel propagates light therethrough from the one lateral surface of the light guide panel to another of the lateral surfaces of the light guide panel opposite to the one lateral surface, wherein the density of reflective patterns closer to the light emitting device is set lower and the density of reflective patterns farther from the light emitting device is set higher to uniformly adjust the overall distribution of quantity of light emerging from the upper side of the light guide panel.

20. The portable terminal as claimed in claim 19, wherein the keypad has at least one protrusion formed on the lower surface of the light guide panel for activating the switch.

21. The portable terminal as claimed in claim 20, wherein the reflective pattern is formed on the lower surface of the light guide panel, which is opposite to the upper surface of the light guide panel, around the protrusion.

* * * * *